US007722183B2

(12) United States Patent
Tanabe

(10) Patent No.: US 7,722,183 B2
(45) Date of Patent: May 25, 2010

(54) IMAGE RECORDING APPARATUS

(75) Inventor: Tsuyoshi Tanabe, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 619 days.

(21) Appl. No.: 11/644,846

(22) Filed: Dec. 26, 2006

(65) Prior Publication Data

US 2007/0146456 A1 Jun. 28, 2007

(30) Foreign Application Priority Data

Dec. 26, 2005 (JP) ..... 2005-372714

(51) Int. Cl.
*B41J 2/01* (2006.01)
*B41J 2/165* (2006.01)
*B41J 29/38* (2006.01)

(52) U.S. Cl. ..... 347/104; 347/35; 347/36; 347/14

(58) Field of Classification Search ..... 347/14, 347/35, 36, 101, 104; 271/198, 275; 101/419
See application file for complete search history.

(56) References Cited

U.S. PATENT DOCUMENTS 6,239,817 B1 * 5/2001 Meyer ..... 347/36
6,733,109 B1 * 5/2004 Lorenz et al. ..... 347/36
6,932,455 B2 * 8/2005 Monclus et al. ..... 347/22
6,966,625 B2 * 11/2005 Silverbrook ..... 347/29
7,021,756 B2 * 4/2006 Nakashima et al. ..... 347/104

FOREIGN PATENT DOCUMENTS

JP 2003-341158 A 12/2003

* cited by examiner

*Primary Examiner*—Shih-Wen Hsieh
(74) *Attorney, Agent, or Firm*—Sughrue Mion, PLLC

(57) ABSTRACT

The image recording apparatus includes a recording head ejecting ink for image recording, a rotatable platen facing the head and has recording medium support surfaces supporting one or more recording media during the image recording, respectively, a driver rotating the platen and a controller controlling the driver so as to rotate the platen in such a way that a predetermined surface selected from the surfaces is stopped at a position facing the recording head. The surfaces support the one or more recording media transported in accordance with different transport patterns, respectively and have ink receivers receiving the ink having reached outside both sides of each of the one or more recording media transported during the image recording and being disposed in positions corresponding to vicinities of both sides of each of the one or more recording media.

10 Claims, 6 Drawing Sheets

IMAGE RECORDING APPARATUS

The entire contents of documents cited in this specification are incorporated herein by reference.

BACKGROUND OF THE INVENTION

The present invention generally relates to an image recording apparatus such as an inkjet printer, and in particular relates to an image recording apparatus having a platen capable of switching ink receiver arrangements, that may suitably be used in borderless printing with a recording medium being transported in a single-row or multiple-row arrangement.

In a case of an inkjet recording apparatus in which recording is performed by ejecting ink from a nozzle of a recording head while moving a carriage on which the recording head is mounted, back and forth, the carriage can be retracted from its recording position when pre-ejecting operation (or flushing) is performed to prevent the nozzle of the recording head from ink clogging.

In a case of an inkjet recording apparatus in which recording is performed by ejecting ink from a nozzle of a recording head while transporting the recording medium with the recording head being fixed, since it requires more space in the apparatus to retract the head from its recording position, an ink absorbing surface is provided on a platen that faces the head so that flushing can be performed against the ink absorbing surface, as described in JP 2003-341158A.

On the other hand, there has been a demand for capability of recording images up to full width of the recording medium to produce a so-called borderless print. In order to achieve such capability, the ink ejecting area of a recording head is required to be wider than the width of the recording medium. Therefore, when using a platen which is configured as described in JP 2003-341158A, in which a recording medium support surface is oriented toward the recording head, ink may be ejected outside the both edges of the recording medium, thus causing the platen to be stained by ink.

Moreover, it has been known that, as one option for increasing productivity, in various image recording apparatuses such as inkjet printers, a single apparatus is required to perform image recording onto a plurality of different width size recording media, or is required to transport multiple rows (multiple in a direction perpendicular to the transport direction) of the recording medium for image recording (drawing) or post treatment subsequent to the image recording. In the description, the direction perpendicular to the transport direction will be referred to as the width direction, and transporting multiple rows of recording medium will be referred to as the parallel transportation.

SUMMARY OF THE INVENTION

However, if a single apparatus performs image recording onto a plurality of different width recording media, as described above, a significant number of countermeasures are needed to prevent the above described ink stain, since a significant number of width sizes and their combinations are available.

The present invention has been made in order to solve the problems described above and an object of the present invention is to provide an image recording apparatus with a platen capable of switching ink receiver arrangements, that may suitably be used for borderless printing by ink-jetting, and that enables one single apparatus to perform image recording onto a plurality of different width size recording media, or allows multiple rows of recording medium to be transported in parallel for performing image recording (drawing) or post treatment subsequent to the image recording.

Another object of the present invention is to provide an image recording apparatus that is not susceptible to recording method of the recording head used in inkjet printing, in other words, that can easily be applicable to either the line head method, or the shuttle method.

In order to achieve the above objective, the present invention provides an image recording apparatus including: a recording head which ejects ink for image recording on one or more recording media; a rotatable platen which faces the recording head, extends in a direction perpendicular to a recording medium transport direction, and includes recording medium support surfaces supporting the one or more recording media during the image recording, respectively; driving means for rotating the rotatable platen; and control means for controlling the driving means so as to rotate the rotatable platen in such a way that a predetermined recording medium support surface selected from the recording medium support surfaces of the rotatable platen is stopped at a position facing the recording head in accordance with a transport pattern of the one or more recording media during the image recording, in which the recording medium support surfaces support the one or more recording media transported in accordance with different transport patterns, respectively and have ink receivers that receive the ink which is ejected from the recording head during the image recording and has reached outside both side edges of each of the supported one or more recording media in the recording medium transport direction and are disposed in positions corresponding to vicinities of both side edges of each of the supported one or more recording media.

Preferably, each of the recording medium support surfaces has suction holes for sucking and supporting the one or more recording media.

Preferably, the rotatable platen further includes an ink absorbing member surface having an ink absorbing member for receiving ink ejected as a pre-ejecting operation of the recording head prior to start of the image recording, and the control means further controls the driving means so as to rotate the rotatable platen in such a way that the ink absorbing member surface is stopped at a position facing the recording head prior to the start of the image recording in accordance with a recording head driving condition of the recording head.

Preferably, the predetermined recording medium support surface corresponds to a predetermined recording medium transport pattern selected from the different recording medium transport patterns and supports the one or more recording media transported in accordance with the predetermined recording medium transport pattern, and the ink receivers are disposed in respective positions corresponding to vicinities of both side edges of each of the one or more recording media transported in accordance with the predetermined recording medium transport pattern.

Preferably, each of the predetermined recording medium support surfaces corresponds to different recording medium transport patterns and supports the one or more recording media transported in accordance with each of the different recording medium transport patterns, and the ink receivers of each of the predetermined recording medium support surfaces are disposed in respective positions corresponding to vicinities of both side edges of each of the one or more recording media transported respectively in accordance with the different recording medium transport patterns to which each of the predetermined recording medium support surfaces corresponds.

The present invention also provides an image recording apparatus including: a recording head which ejects ink for image recording on one or more recording media; a rotatable platen which faces the recording head, extends in a direction perpendicular to a recording medium transport direction, and has recording medium support surfaces, each of the recording medium support surfaces corresponding to each of different recording medium transport patterns and supporting the one or more recording media transported in accordance with each of different recording medium transport patterns during the image recording; driving means for rotating the rotatable platen; and control means for controlling the driving means so as to rotate the rotatable platen in such a way that a predetermined recording medium support surface corresponding to a predetermined recording medium transport pattern selected from the different recording medium transport patterns is stopped at a position facing the recording head, in which the predetermined recording medium support surface has ink receivers that receive the ink which is ejected from the recording head during the image recording and has reached outside both side edges of each of the one or more recording media in the recording medium transport direction transported in accordance with the selected predetermined recording medium transport pattern and are disposed in positions corresponding to vicinities of both side edges of each of the transported one or more recording media.

Preferably, each of the recording medium support surfaces has suction holes for sucking and supporting the one or more recording media.

Preferably, the rotatable platen further includes an ink absorbing member surface having a ink absorbing member for receiving ink ejected as a pre-ejecting operation of the recording head prior to start of the image recording, and the control means controls the driving means so as to rotate the rotatable platen in such a way that the ink absorbing member surface corresponding is stopped at a position facing the recording head prior to the start of the image recording in accordance with a recording head driving condition of the recording head.

Preferably, each of the predetermined recording medium support surfaces has the ink receivers disposed in respective positions corresponding to vicinities of both side edges of each of the one or more recording media transported in accordance with the different recording medium transport patterns.

Preferably, the ink receivers disposed on each of the predetermined recording medium support surfaces correspond to two or more different recording medium transport patterns.

An embodiment according to the present invention achieves an image recording apparatus with a platen capable of switching ink receiver arrangements, that may suitably be used for borderless printing by ink-jetting, and that enables one single apparatus to perform image recording onto a plurality of different width size recording media, or allows multiple rows of recording medium to be transported in parallel for performing image recording (drawing) or post treatment subsequent to the image recording.

The image recording apparatus according to the present invention is not susceptible to the recording method of the recording head used in inkjet printing, in other words, that can easily be applicable to either the line head method, or the shuttle method.

BRIEF DESCRIPTION OF THE DRAWINGS

In the accompanying drawings:

FIG. 2A shows a top view, and FIG. 2B shows an explanatory view on Arrow Y-Y of 2A;

FIG. 3A shows a top view, and FIG. 3B shows an explanatory view on Arrow Y-Y of 3A;

FIG. 4A shows a top view, and FIG. 4B shows an explanatory view on Arrow Y-Y of 4A;

FIGS. 5A and 55 illustrate a detailed configuration (Part 4) of a recording unit, which is a main part of the image recording section of a printer according to the embodiment, and FIG. 5A shows a top view, FIG. 6A shows a top view, and FIG. 6B shows an explanatory view on Arrow Z-Z of 6A.

DETAILED DESCRIPTION OF THE INVENTION

An image recording apparatus of the present invention will hereinafter be described in detail on the basis of a preferred embodiment shown in the accompanying drawings.

Figure 1:
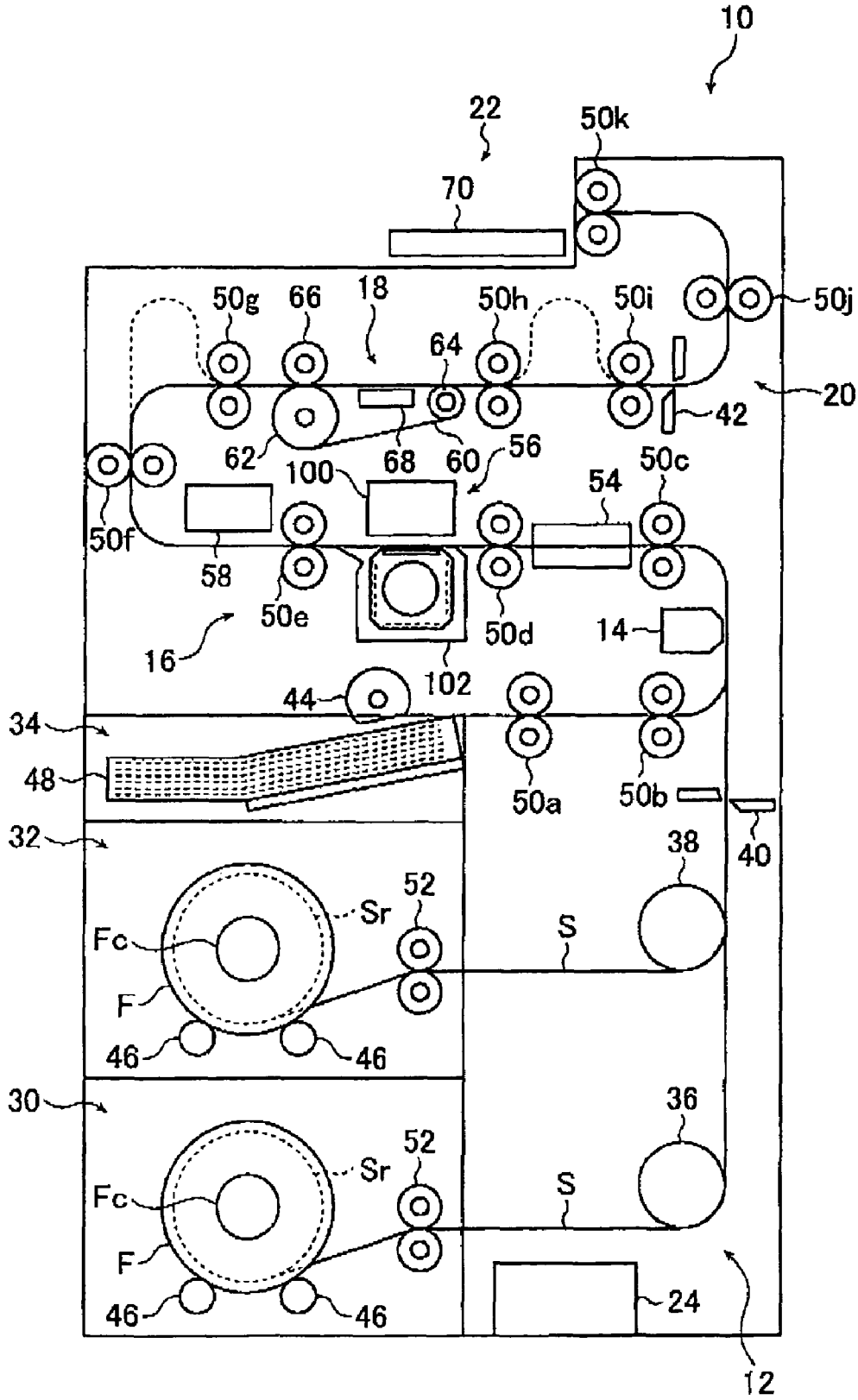
FIG. 1 illustrates a schematic view of one example of a (inkjet) printer according to one embodiment of the present invention.

FIG. 1 shows a schematic view of an inkjet printer according to one embodiment of the present invention.

The inkjet printer (hereinafter simply referred to as the printer) 10 shown in FIG. 1, in order to generate a print, performs not only image recording by ink-jetting onto a recording sheet S as the recording medium, but also performs backprinting or surface processing as needed, so that photography equivalent quality is achieved. The printer 10 basically includes a recording sheet feeding section 12, a backprinting unit 14, an image recording section 16, a surface processing section 18, a cutting section 20, and a discharging section 22.

Also, the printer 10 includes a control section 24 for controlling and managing entire operation of the printer 10, as well as for managing operation histories of the printer 10.

It should be understood that the printer 10 may also include, in addition to those members shown in the drawings, a transport roller pair, a guide roller, a guide member, a sensor for detecting the recording sheet S, and other various members that are employed in known printers, as necessary.

The recording sheet feeding section 12 is a section for feeding the recording sheet S as the recording medium to the backprinting unit 14, and includes a first loading section 30, a second loading section 32, a cut sheet loading section 34, guide rollers 36, 38, a cutter 40, a sheet feeding roller 44, and two transport roller pairs 50 (50*a*, 50*b*).

The first loading section 30 and the second loading section 32 load a recording sheet roll Sr formed of a long recording sheet S rolled around a core member, and feed the recording sheet roll Sr to the backprinting unit 14 (and subsequent sections), through the cutter 40 which will be described later. If the recording sheet S has an ink receiving layer, the ink receiving layer is oriented toward outside when being rolled.

Since the first loading section 30 and the second loading section 32 are the same in structure, except that the location in the printer 10 is different, similar components are denoted by same reference numerals, and only the first loading section 30 will be described below as the representative.

The first loading section 30 (second loading section 32) has two flange rotating rollers 46 and a feed roller pair 52. The flange rotating rollers 46 are arranged in the transport direction with a predetermined space between them, and their rotating direction is aligned with the feeding direction of the recording sheet S (i.e., their axial direction is perpendicular to the document plane of FIG. 1).

The feed roller pair 52 is a known transport roller pair. The flange rotating rollers 46 and the feed roller pair 52 are both engaged to a known rotation driving source (not shown) through which the flange rotating rollers 46 and the feed roller pair 52 are driven to rotate in a forward (feeding) or backward (rewinding) direction.

In the printer 10 shown in the drawing, the recording sheet roll Sr is held (in the axial direction) by two disk-shaped flanges F having a cylinder portion Fc therebetween, which will be inserted in the core material. The flanges F are then mounted on the two flange rotating rollers 46 so that the recording sheet roll Sr is loaded in a predetermined position of the printer 10 (the first loading section 30 and the second loading section 32). The outer diameter of the flange F is greater than the maximum outer diameter of applicable recording sheet rolls Sr.

If printing is performed in a two-row parallel transport mode which will be described later, two recording sheet rolls Sr, while being held by the flanges F, are mounted on the flange rotating rollers 46 in the axial direction (perpendicular to the document plane of FIG. 1).

In the first loading section 30 (second loading section 32), the flange F is rotated and synchronized with the flange rotating rollers 46, and the recording sheet S is transported by the feed roller 52 to allow the recording sheet S to be fed out from the recording sheet roll Sr. The flange F also serves as a guide member in feeding the recording sheet S.

It should be understood that in the practice of the present invention, the loading method of the recording sheet roll Sr is not limited to the above, and any other method available in various printers may be used. For example, a recording sheet roll Sr with its center being rotatably supported is housed in a magazine and the magazine is loaded to a predetermined loading position.

The recording sheet S of the recording sheet roll Sr which is loaded to the first loading section 30 is transported (fed) to the backprinting unit 14 through the cutter 40, then to the image recording section 16, while being guided by the guide roller 36. The recording sheet S of the recording sheet roll Sr which is loaded to the second loading section is conveyed to the backprinting unit 14 through the cutter 40, then to the image recording section 16, while being guided by the guide roller 38.

The cutter 40 may be a known Guillotine cutter. The cutter 40 may not be used for cutting the recording sheet S on an each print basis, rather, used for cutting the recording sheet S on an order basis, similar to shutting down the operation of the printer 10 in order to interrupt (abort) printing at a predetermined (preselected) timing.

In other words, in the printer 10 shown, when printing is performed onto the recording sheet S of the recording sheet roll Sr, backprinting is performed by the backprinting unit 14, image recording is performed by the image recording section 16, and surface treatment (if necessary) is performed by the surface processing section 18 onto the long recording sheet S as it is, and then the long recording sheet S is cut by the cutting section 20 to produce individual prints P.

Accordingly, when printing is performed using the recording sheet S of the recording sheet roll Sr, the recording sheet S is fed out from an active loading section of either the first loading section 30 or the second loading section 32 and transported along a predetermined route through the guide roller 36 or 38, and cutter 40, until its leading edge is positioned in a predetermined position (for example, a transport roller pair in the most upstream side of the image recording section 16), in a similar way as used in other known printers using a rolled recording medium (so called roll sheet).

If the recording sheet S is cut by the cutter 40, and if the remaining recording sheet S is not used in the subsequent printing, the flange rotating rollers 46 and the feed roller pair 52 are inversely rotated so that the recording sheet S is retracted to a predetermined position. In this case, the flange F also serves as a guide for guiding the recording sheet S to allow the recording sheet S to be rewinded appropriately toward the recording sheet roll Sr.

The cut sheet loading section 34 is a section for loading cut sheet type recording sheets S, which are produced by cutting the long recording sheet S into a plurality of sheets each having a predetermined size.

The cut sheet type recording sheets S are accommodated in a known cassette 48 as used in various printers, and the cassette 48 is loaded in a predetermined position of the cut sheet loading section 34, so that the cut sheet type recording sheets S are loaded in a predetermined position of the printer 10. In the example shown in the drawings, it an ink receiving layer is provided, the cut sheet type recording sheets S are accommodated in the cassette 48 with the ink recording layer being oriented downward.

Each of the cut sheet type recording sheets S accommodated in the cassette 48 is then pulled out from the cassette 48 by the sheet feeding roller 44 which is a semilunar roller with a side peripheral surface cut into a plane shape. Then the cut sheet type recording sheet S is transported by the transport roller pairs 50*a* and 50*b*, and fed to the backprinting unit 14 by, such as, a not-shown guide.

In the printer 10 shown in the drawing, there is no limitation on the recording sheet S, and any known recording sheet S (image receiving sheet (image receiving medium)) may be used. For example, a plan sheet, an inkjet recording sheet with a matte or glossy surface having an ink receiving layer, an inkjet recording sheet (refer to JP 2005-35050 A) having an ink receiving layer made of thermal plastic resin particles and a layer for absorbing pigment ink solvent provided underneath the ink receiving layer, and an inkjet recording sheet for photographic image quality printing that has an ink-philic thermal plastic resin layer as an ink receiving layer may be used.

Examples of thermal plastic resin that may be used for inkjet recording sheet for photographic image quality printing include poly acrylic ester, polycarbonate, polyacrylonitrile, polystyrene, polybutadiene, poly (meth) acrylic acid, polyvinyl chloride, poly vinylidene chloride, polyvinyl acetate, polyester, polyamide, polyether, and copolymers thereof. Among the copolymers, poly acrylic ester copolymer, styrene-acrylic ester copolymer, polyvinyl chloride-acetic copolymer, polyvinyl chloride-acrylic ester copolymer, ethylene-vinyl acetate copolymer, ethylene-acrylic ester copolymer, and SBR latex are preferably exemplified.

The printer 10 according to the present invention is not limited to those uses both the roll sheet and the cut sheet as described above, and only the roll sheet or only the cut sheet can be used.

In addition, if the roll sheet is used, the recording sheet S may be cut just after being pulled out from the recording sheet roll so that backprinting or image recording is performed on the cut sheet, instead of cutting the roll sheet into individual prints in the last stage.

The backprinting unit 14 performs backprinting on a back surface (or non image printing surface in the case of the recording sheet S having an ink receiving layer) of the recording sheet S by using such as a dot impact printer. Backprinting may also be performed by using an inkjet printer or a thermal printer.

There is no limitation on the content of the backprinting, and various types of information, which are standard in photographic printing, may be exemplified as the content of backprinting.

The image recording section 16 is a section for recording an image onto the long recording sheet S, or cut sheet type recording sheet S. The image recording section 16 includes, in the order from upstream side toward downstream side, a regulating guide 54, a recording unit 56 for recording an image onto the recording sheet S, and a drying means 58 for drying the recording sheet S on which an image is recorded. A transport roller pair 50*c* is arranged upstream of the regulating guide 54, a transport roller pair 50*d* is arranged between the regulating guide 54 and the recording unit 56, and a transport roller pair 50*e* is arranged between the recording unit 56 and the drying means 58, respectively.

The regulating guide 54 arranged upstream of the recording unit 56 (between the transport roller pair 50*c* and the transport roller pair 50*d*) regulates the recording sheet S with respect to positions in a direction (i.e., width direction) perpendicular to the transport direction of the recording sheet S fed to the recording unit 56 for recording an image by inkjet so that the recording sheet S is transported to a predetermined position.

The recording unit 56 arranged downstream of the regulating guide 54 (transport roller pair 50*d*) includes recording means 100 of known ink-jetting using an inkjet recording head (hereinafter referred to as the recording head), and a platen (rotatable platen, which will be described later in detail) 102 as supporting means for the recording sheet S, which faces the recording head. The recording unit 56 performs known image recording of a full color image by ink-jetting.

The method of image recording (drawing) performed by the recording means 100 may be any known method used in inkjet printers, without any particular limitation.

For example, a method of image recording based on so called FWA (Full Width Array) technology may be used in the recording means 100, in which a line head having a nozzle array (an array of nozzles for ejecting ink droplets) which is longer than the maximum width of recording sheet S is used, and image recording is performed by ejecting ink droplets according to the width of the recording sheet S, from an array of nozzles which is equal or slightly longer than the width of the recording sheet S while sequentially transporting (scanning and transporting) the recording sheet S.

A method of image recording based on so-called PWA (Partial Width Array) technology may also be used in the recording means 100, in which a small type of recording head is mounted on a carriage (scanning means) with its nozzle array aligned with the transport direction of the recording sheet S. The recording sheet S is intermittently transported, and while the transportation of the recording sheet S is stopped, image recording is performed by scanning the recording head in the width direction to allow an array of nozzles to eject ink droplets according to the width of the recording sheet S.

Accordingly, if the recording means 100 performs image recording based on FWA technology, the transport roller pairs 50*c*-50*e* (and 50*f* which will be described later) transport the recording sheet S in a sequential manner, and if the recording means 100 performs image recording based on PWA technology, the transport roller pairs 50*c*-50*e* (and 50*f* which will be described later) transport the recording sheet S in an intermittent manner.

The platen 102, which will be described later in detail, is of a squire column in this example, and includes, on the surface of the column a plurality of (for example, three) recording medium support surfaces as the surfaces for transporting the recording sheet S, and an ink absorbing member surface for receiving ink pre-ejected (flushed) from the recording head. In each of the recording medium support surfaces, suction holes are provided so that lifting of the recording sheet S is prevented appropriately, for example, by sucking from inside, ensuring the recording sheet S to be regulated to a predetermined position, more reliably and accurately.

Moreover, each of the recording medium support surfaces of the platen 102 has an ink receiver of a groove shape for example, which is formed according to the width of applicable recording sheets S so as to prevent contamination with ink during so-called borderless printing in which image is recorded up to the edge of the print. This may be achieved by embedding an ink absorbing member in the groove of the groove shaped ink receiver, or by forming the ink receiver using an ink absorbing member.

The drying means 58 is arranged downstream of the recording unit 56 (that is, the platen 102 and the recording means 100).

The drying means 58 dries ink on the recording sheet S subjected to image recording by ink-jetting. There is no limitation on the drying means 58, and any known means may be employed, such as, using a heater, or a fan, or using both heater and fan.

The transport roller pair 50*e*, which is disposed between the platen 102 and the drying means 58, is detachable, so that a space can be provided as necessary to prevent attachment of ink before being dried.

The recording sheet S that has been dried by the drying means 58, is then transported to the surface treatment section 18 by the transport roller pairs 50*f* and 50*g*. Between the transport roller pair 50*f* and the transport roller pair 50*g*, a loop forming portion for the recording sheet is provided, which will also be described in detail later.

The surface treatment section 18 performs surface treatment on an ink receiving layer (thermal plastic resin), in the case where the inkjet recording sheet for photographic image quality printing having an ink receiving layer made of thermal plastic resin particles or ink-philic thermal plastic resin as described above, is used as the recording sheet S.

In the case where a recording sheet S other than those described above is used, surface treatment in the surface treatment section 18 is not necessary in general. Therefore, the recording sheet S is preferably transported toward downstream after no treatment is performed in the surface treatment section 18 by separating the nip roller 66 from the surface treatment belt 60.

It should be understood that even if a recording sheet S other than the inkjet recording sheet for photographic image quality printing is used, the recording sheet S can be subjected to surface treatment as needed, as will be described later.

The surface treatment section 18 uses the surface treatment belt 60 to perform surface treatment on the recording sheet S, in such a manner that the surface (ink receiving layer) of the recording sheet S is brought into contact with the surface of the surface treatment belt 60, and pressed/heated, and then cooled.

In the example shown in the drawing, the surface treatment section 18 includes in addition to the surface treatment belt 60, a heating roller 62, a roller 64, the nip roller 66, and a cooling section 68. The surface treatment belt 60, which is an endless belt, is stretched across the heating roller 62 and the roller 64.

The surface treatment belt 60 has a surface (outer surface) having an extremely high smoothness. The heating roller 62 is a known heating roller that emits heat of a temperature applicable to heating treatment of the recording sheet S. The cooling section 68 cools the surface treatment belt 60 by abutting it from its inside, to allow the recording sheet S which is transported by the surface treatment belt 60 to be cooled. The nip roller 66 abuts and presses the surface treatment belt 60 at a position corresponding to the heating roller 62, so as to press the recording sheet S against the surface treatment belt 60 and to nip and transport the recording sheet S along with the surface treatment belt 60.

There is no limitation on the heating means in the heating roller 62, as well as cooling means in the cooling section 68, and any known means can be used. The nip roller 66 may also have heating means.

As apparent from FIG. 1, the recording sheet S on which an image has been recorded by ink-jetting is transported to the surface treatment section 18 with its image forming surface oriented toward the surface treatment belt 60.

In the surface treatment section 18, firstly, the recording sheet S is held and transported by the surface treatment belt 60 (heating roller 62) and the nip roller 66. Then the recording sheet S is heated by the heating roller 62, while the surface (ink receiving layer) of the recording sheet is abutted against the surface of the surface treatment belt 60.

Through the heating/pressing, the recording sheet S becomes slightly adhesive to the surface treatment belt 60 due to melt of the ink receiving layer made of thermal plastic resin. The recording sheet S is transported by the surface treatment belt 60, while slightly adhering thereto. During the transportation, in the surface treatment section 18, the recording sheet S is cooled by the cooling section 68 to set the melted ink receiving layer.

The recording sheet S that has been cooled is separated from the surface treatment belt 60 at a fold back part of the roller 64 and then fed to the transport roller pair **50*h*** in the downstream.

The ink receiving layer (thermal plastic resin) of the recording sheet S is thus pressed against the surface treatment belt 60 and heated/melted into an adhesive status. The ink receiving layer is then cooled/set so that the surface property of the surface treatment belt 60 is transferred to the ink receiving layer. As already described above, the surface treatment belt 60 has an extremely high surface smoothness. Therefore, the recording sheet S on which the surface property of the surface treatment belt 60 has been transferred will have a high surface smoothness and good glossiness, which allows production of a high quality print comparative to the silver halide photograph.

Moreover, the surface treatment of the recording sheet S allows not only imparting of glossiness, but also providing various other surface treatments such as matting (roughing), by selecting a desired surface property of the surface treatment belt 60.

The printer 10 may have a feature for controlling the heating condition and/or cooling condition in the surface treatment section 18 so as to control the glossiness to be imparted to the surface of the recording sheet S (print).

Moreover, in the example shown in the drawings, stiffness inherent in the recording sheet S is utilized to separate the recording sheet S from the surface treatment belt 60. Therefore, if reducing the diameter of the roller 64 that stretches the surface treatment belt 60 at a position where the recording sheet S is discharged from the surface treatment section 18 as shown in FIG. 1, the separation property in separating the recording sheet S from the surface treatment belt 60 can be improved.

The recording sheet S that has been subjected to surface treatment in the surface treatment section 18, or has passed through the surface treatment section 18 is then transported to the cutting section 20 by the transport roller pair **50*h* and 50*i*. Between the transport roller pair 50*h* and transport roller pair 50*i***, a loop forming portion for the recording sheet is provided, which will also be described in detail later.

The cutting section 20 uses a cutter 42 of a known Guillotine cutter to cut, in the width direction, a long recording sheet S that has been supplied from the first loading section 30 or the second loading section 32, recorded an image by ink-jetting in the image recording section 16, and, if necessary, subjected to surface treatment in the surface treatment section 18, so that individual prints are obtained (the recording sheet is cut into prints one by one).

It should be noted that the cutting section 20 of the printer 10 is not limited to cutting a long recording sheet S (rolled sheet). The cutting section 20 may be used, for example, in the case where a cut sheet type recording sheet S supplied from the cut sheet loading section 34 is used, to cut the leading/trailing edge (in the transport direction) of the cut sheet type recording sheet S in order to adjust the size for outputting, or to cut the leading/trailing edge of a so-called borderless print in which an image is recorded up to the edges.

While, in the printer 10 shown in the drawings, the cutting section 20 includes only the cutter 42 to cut the recording sheet S in the width direction, the present invention is not limited to this.

For example, if the recording unit 56 performs a so-called multi-imposition printing in the width direction, in which two or more images are recorded in the width direction, cutting means such as a slitter may be provided in the cutting section 20 to cut the recording sheet S in the transport direction.

As described above, each loop forming portion for forming a loop of the recording sheet S (a slack in the recording sheet S) is provided between the transport roller pair **50*f* and the transport roller pair 50*g*, where the recording sheet S is transported from the image recording section 16 to the surface treatment section 18, and between the transport roller pair 50*h* and the transport roller pair 50*i*, where the recording sheet S is transported from the surface treatment section 18 to the cutting section 20**.

The surface treatment section 18 performs surface treatment by heating/melting the ink receiving layer of the recording sheet S and transporting/cooling the recording sheet S with the recording sheet S slightly adhering to the surface treatment belt 60.

Therefore, in the surface treatment section 18, if the transport of the recording sheet S is stopped, over-heating or over-cooling may occur to cause unevenness in the surface treatment, resulting in uneven glossiness. For this reason, the transport of the recording sheet S is not allowed to stop during the process in the surface treatment section 18.

Also, if load fluctuation occurs during the treatment in the surface treatment section 18, for example, in the event the recording sheet S is forcedly pushed into the surface treatment section 18, or pulled from the surface treatment section 18, the recording sheet S which is adhered to the surface treatment belt 60 can be out of sync with the belt, which also causes uneven glossiness.

However, if the recording means 100 performs image recording based on PWA technology, the recording sheet S is transported in an intermittent manner. Also, even if the recording means 100 performs image recording based on FWA technology, the transport speed (scan transport speed) corresponding to the image recording by the recording means 100 may be different from the transport speed corresponding to the surface treatment by the surface treatment section 18.

On the other hand, since the cutting section 20 uses Guillotine cutter 42, it is necessary to stop the transport of the recording sheet S, when cutting.

Accordingly, in the printer 10, when a print is produced using a long recording sheet S (rolled sheet) supplied from the first loading section 30 or the second loading section 32, the edge of the recording sheet S is stopped by the transport roller pair 50*g*, without stopping the recording sheet S in the surface treatment section 18. After a loop of the recording sheet S of a length sufficient to prevent any load fluctuation on the transport of the recording sheet S in the surface treatment section 18 is formed between the transport roller pairs 50*f* and 50*g*, the transport by the roller pair 50*g* is started to transport the recording sheet S to the surface treatment section 18.

Also, when a print is produced using a long recording sheet S, similarly to the above, the edge of the recording sheet S is stopped by the transport roller pair 50*i*, without stopping the recording sheet S in the surface treatment section 18. After a loop of the recording sheet S of a length sufficient to prevent any load fluctuation on the transport of the recording sheet S in the surface treatment section 18 is formed between the transport roller pairs 50*i* and 50*h*, the transport by the roller pair 50*i* is started to transport the recording sheet S to the cutting section 20 (Guillotine cutter 42).

The transport speed of the transport roller pairs 50*g* and 50*h* is controlled to synchronize to the transport speed of the recording sheet in the surface treatment section 18 so as to prevent any load fluctuation on the transport of the recording sheet in the surface treatment section 18.

The transport by the transport roller pairs 50*i* and 50*g* may be performed in an intermittent manner so as to correspond to the operation of the Guillotine cutter 42.

The recording sheet S, i.e., the print, which has been cut by the cutting section 20 (Guillotine cutter 42) is discharged by the transport roller pairs 50*j* and 50*k* to the discharging section 22.

The discharging section 22 uses an orthogonal transport belt (belt conveyor) 70 traveling in the depth direction in the document surface of FIG. 1, to sort the prints on an each order basis. The prints are discharged by the transport roller pair 50*k* onto the orthogonal transport belt 70 of the discharging section 22, and stacked thereon. When the prints for one order are stacked, the stacked prints are transported by the orthogonal transport belt 70 by a distance corresponding to the size of one print (a length in the width direction) in the depth direction so that a portion of the belt on which no prints are stacked will be used as a discharge position from the transport roller pair 50*k*. The orthogonal transport belt 70 repeats the stacking/transporting so that the prints are sorted on an each order basis.

Referring now to FIGS. 2A, 2B, 3A, 3B, 4A, 4B, 5A, and 5A, in which examples of detailed configuration of the recording unit 56 which is a main part of the recording section 16 the printer 10 according to this embodiment, description will be given on the specific configuration of the recording means 100 based on known ink-jetting, and a rotatable platen 102 that supports the recording sheet S being transported in a direction shown by Arrow F.

In the examples shown below, as the recording means 100, an image recording apparatus based on the above described FWA technology is used. However, it is shown as an example, and of course an image recording apparatus based on PWA technology may also be used.

As shown in FIGS. 2B, 3B, 4B, and 5B, the recording unit 56 of the printer 10 according to the present invention, includes a recording head 100*a* that constitutes the recording means 100, and a rotatable platen 102 that is arranged so as to face the recording head 100*a*.

The recording head 100*a* is configured so as to allow ink to be ejected toward only a desired region in the recording sheet transport direction, through the control section 24 (in other words, ink ejection can be controlled so that only a desired region is printed as necessary). This configuration is effective when performing borderless printing onto recording sheets S being transported in parallel, allowing only desired regions of each recording sheet S to be printed efficiently. It is needless to say that, in borderless printing, the recording head 100*a* is controlled by the control section 24 to allow only nozzles corresponding to the width of the recording sheet to eject ink according to the width of the recording sheet, in the width direction of the recording sheet.

Next, the rotatable platen 102 will be described in detail by referring to FIGS. 2A, 2B, 3A, 3B, 4A, 4B, 5A, and 5B.

As already described, the rotatable platen 102 basically includes a plurality of (three, in the drawings) recording medium support surfaces. In the examples shown, the rotatable platen 102 of a squire column includes in addition to the three recording medium support surfaces (A, B, C), one ink absorbing member surface (D) formed of an ink absorbing member for receiving ink ejected as pre-ejection operation of the recording head 100*a*.

Figure 3A:
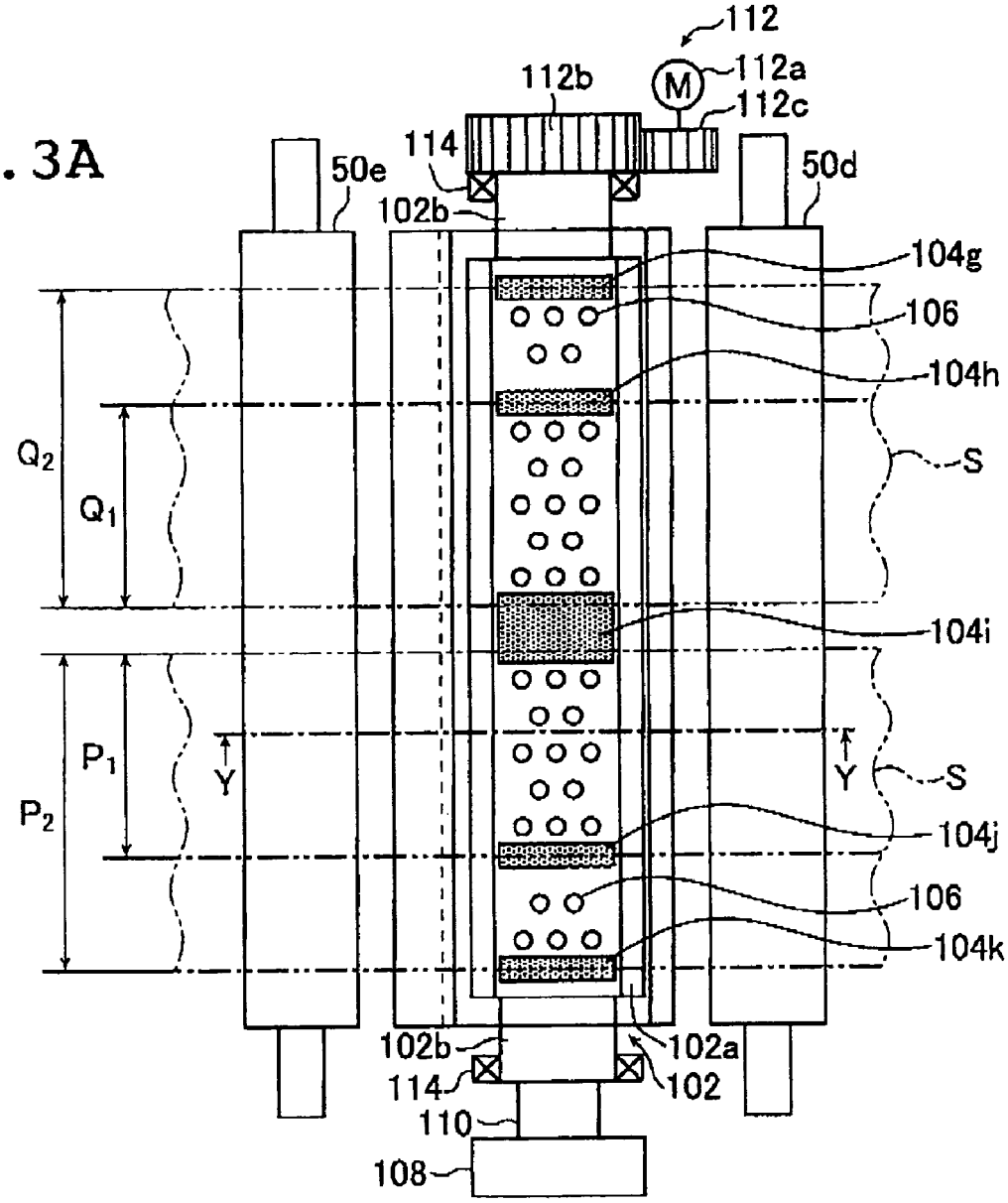
FIGS. 3A and 3B illustrate a detailed configuration (Part 2) of a recording unit, which is a main part of the image recording section of a printer according to the embodiment.
Figure 3B:
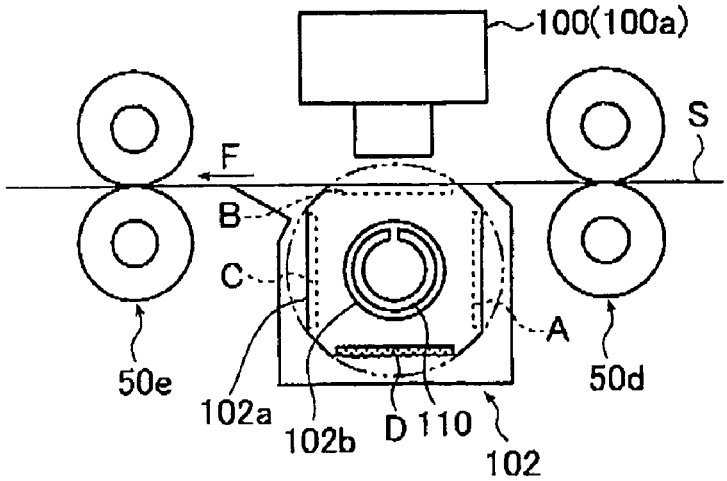
Figure 4A:
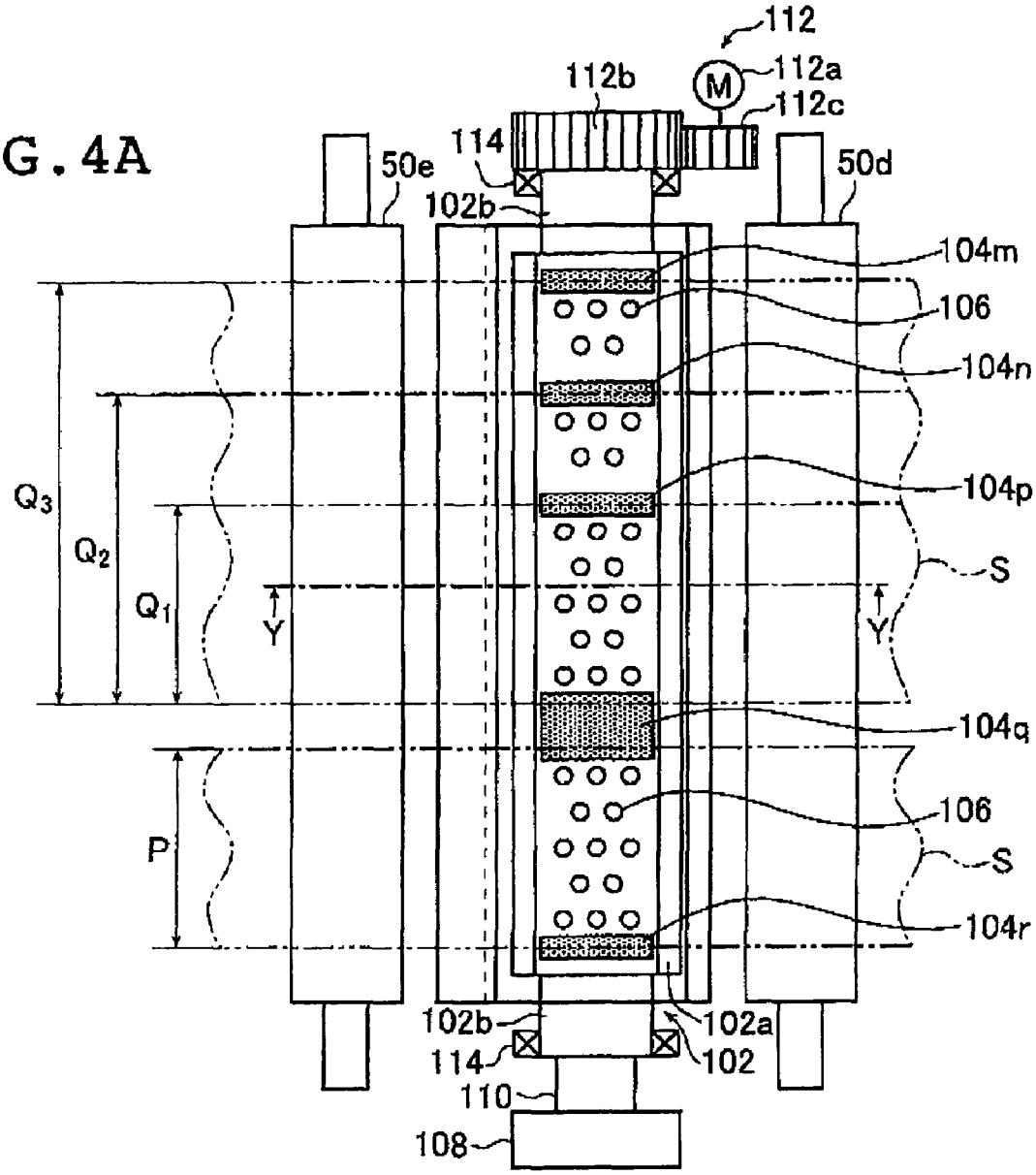
FIGS. 4A and 4B illustrate a detailed configuration (Part 3) of a recording unit, which is a main part of the image recording section of a printer according to the embodiment.
Figure 4B:
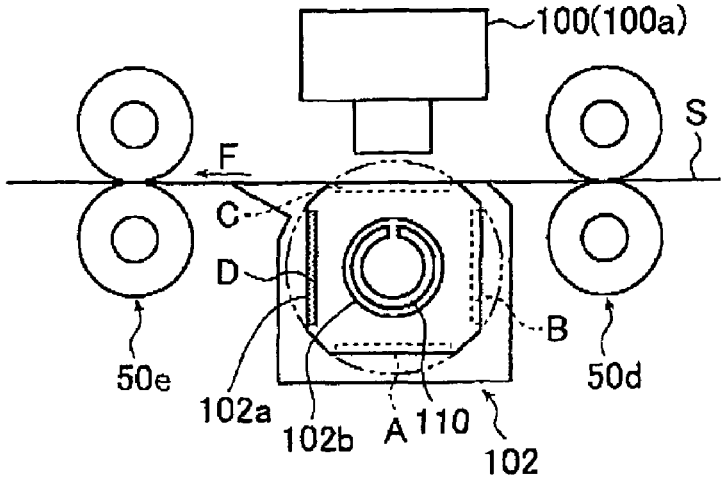
Figure 5A:
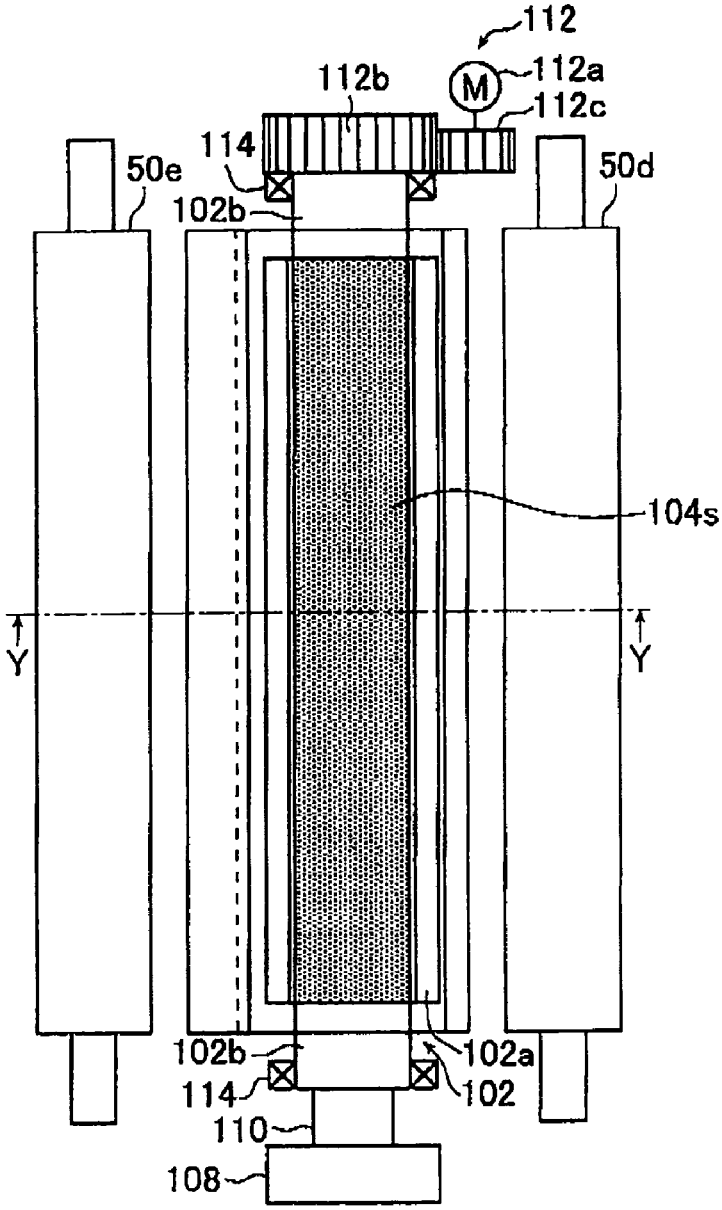
Figure 5B:
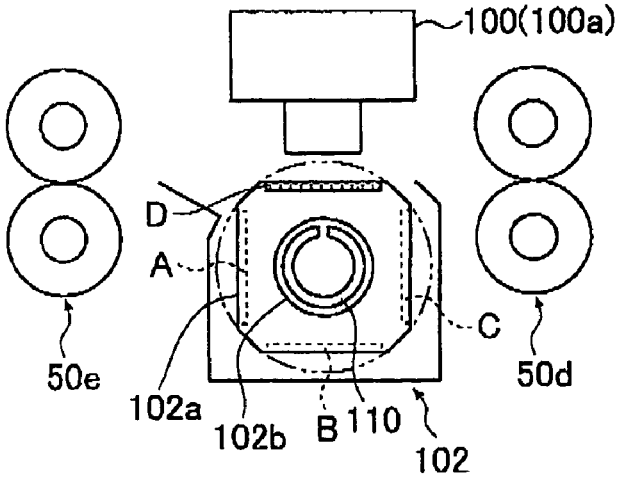
FIG. 5B shows an explanatory view on Arrow Y-Y of 5A.

Examples of specific configuration shown in FIGS. 2A, 2B, 3A, 3B, 4A, 4B, 5A, and 5B, illustrate each status in which each of the three recording medium support surfaces (A-C; FIGS. 2A, 2B, 3A, 3B, 4A, and 4B), or the ink absorbing member surface (D; FIGS. 5A and 5B) of the rotatable platen 102 is positioned on the surface facing the recording head 100*a*. FIGS. 2A, 3A, 4A, and 5A are top views of the recording medium support surfaces or the ink absorbing member surface in that status, and the vicinity thereof. FIGS. 2B, 3B, 4B, and 5B are views on Arrow Y-Y (showing only main parts) respectively corresponding to FIGS. 2A, 3A, 4A, and 5A, as well as showing each positional relationship with respect to the recording head 100*a*.

In the following description, the configuration of the recording medium support surfaces and ink absorbing member surface will be described, using a first recording medium support surface shown in FIG. 2B as an example. Hereinafter, a first recording medium support surface shown in FIG. 2B will be referred to as Surface A of the rotatable platen 102. Similarly, second and third recording medium support surfaces shown in FIGS. 3B and 4B in detail, will be referred to as Surfaces B and C, respectively. The ink absorbing member surface shown in FIG. 5B will be referred to as Surface D.

Figure 2A:
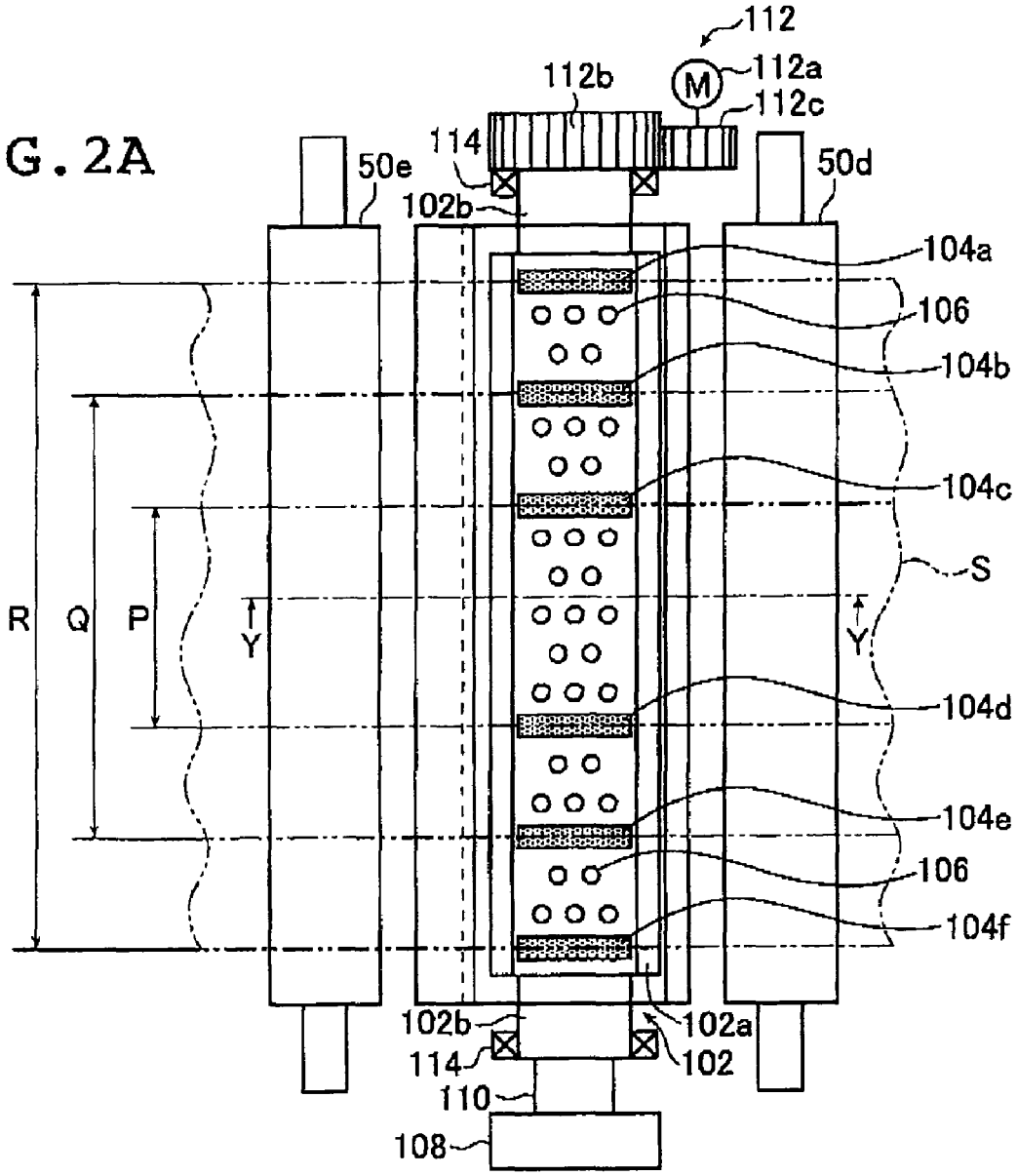
FIGS. 2A and 2B illustrate a detailed configuration (Part 1) of a recording unit, which is a main part of an image recording section of a printer according to the embodiment.

As shown in FIG. 2A, in Surface A of the rotatable platen 102, there provided are ink receivers 104*a*-104*f* having patterns different from those on Surfaces B, C, which will be described later, as well as a plurality of suction holes 106 for sucking the recording sheet S, which are arranged without overlapping with the ink receivers 104*a*-104*f*.

The ink receivers 104*a*-104*f* formed on Surface A of the rotatable platen 102 will be described, as to performing borderless printing by ink-jetting onto the recording sheet S in three different width sizes (P, Q, and R) using center alignment. The ink receivers 104*c*, 104*d* are provided as a first ink receiver pair corresponding to both edges of a recording sheet S having a width size of P. The ink receivers 104*b*, 104*e* are provided as a second ink receiver pair corresponding to both edges of a recording sheet S having a width size of Q. The ink receivers 104*a*, 104*f* are provided as a third ink receiver pair corresponding to both edges of a recording sheet S having a width size of R.

In the description, the rotatable platen 102 is configured in a squire pole having three recording medium support surfaces and one ink absorbing member surface. However, it should be noted that the number of surfaces on the circumference of the rotatable platen 102 is not limited to this, and the rotatable platen 102 may be of a regular polygonal column having any number of surfaces.

Figure 6A:
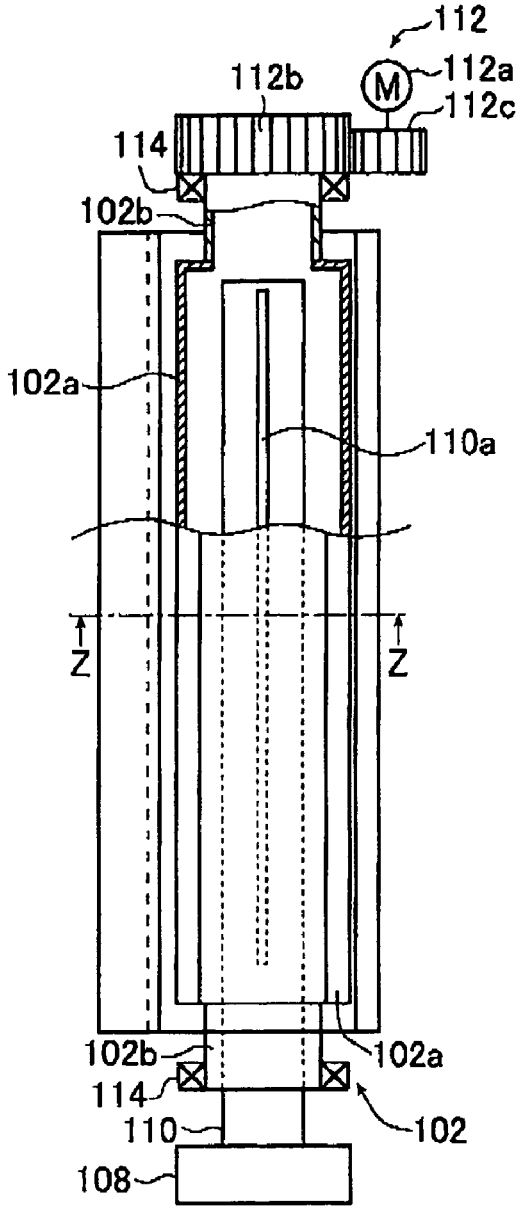
FIGS. 6A and 6B illustrate a detailed configuration (Part 5) of a recording unit, which is a main part of the image recording section of a printer according to the embodiment.
Figure 6B:
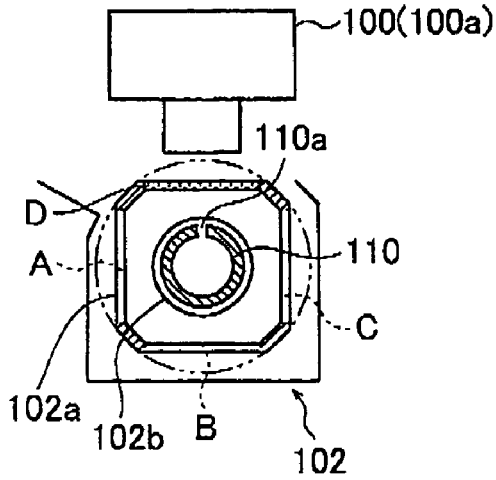

Inside the rotatable platen 102, an air suction duct 110 is provided for sucking the recording sheet S through the suction holes 106 as shown in FIGS. 6A and 6B. The air suction duct 110 is connected to air suction means 108, such as a vacuum pump. The squire column rotatable portion 102*a* (rotatable portion of the rotatable platen 102) which has three recording medium support surfaces and one ink absorbing member surface is configured to be rotatable around the air suction duct 110. Under the control of the control section 24, the rotatable portion 102*a* rotates around the air suction duct 110 in order for a predetermined recording medium support surface or ink absorbing member surface to be aligned in a position facing the recording head 100*a*.

In FIGS. 6A and 6B, the air suction duct 110 has a slit 110*a*. The slit 110*a* is arranged in a position facing the recording head 100*a* and made in contact with the inner surface of the ink absorbing member surfaces A-C that perform air suction (and also made in contact with the ink absorbing member surface D actually).

As shown in FIGS. 2A, 2B, 3A, 3B, 4A, 4B, 5A, 5B, 6A, and 6B, a driving mechanism is provided for rotating the rotatable portion 102*a* of the rotatable platen 102. The driving mechanism, in this embodiment, consists of, a driving means 112 including a bearing 114 for rotatably supporting a hollow rotation axis portion (of rotatable portion) 102*b*, and gears 112*b*, 112*c* for connecting between the hollow rotation axis portion 102*b* and the shaft of the motor 112*a*.

Figure 2B:
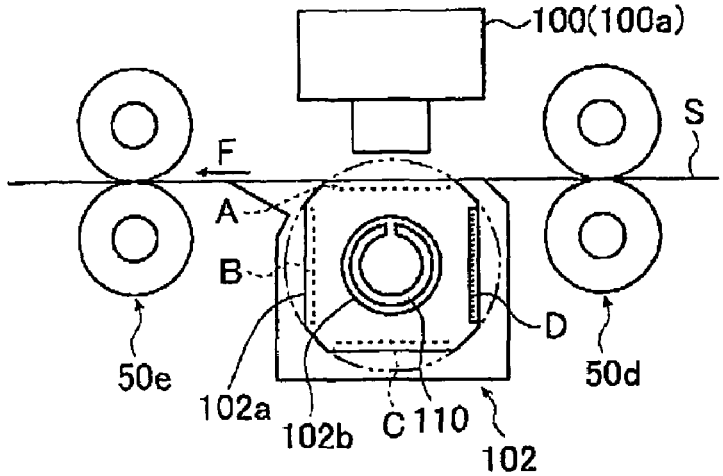

In this embodiment, in the rotatable portion 102*a* of the rotatable platen 102, corner portions of the squire pole are cut, for example, as shown in FIG. 2B, so that when the rotatable portion 102*a* rotates, its outer most circumference travels a rotation truck shown by a chain double-dashed line in the drawing, which prevents the rotatable portion 102*a* from abutting against the recording head 100*a*, while reducing the distance between the recording head 100*a* and the rotatable platen 102 to a minimum distance.

Next, the second recording medium support surface (Surface B) shown in FIG. 3B, and the third recording medium support surface (Surface C) shown in FIG. 4B will be described.

The second recording medium support surface (Surface B) shown in FIG. 3B, and the third recording medium support surface (Surface C) shown in FIG. 4B are basically the same in configuration as the first recording medium support surface (Surface A) shown in FIG. 2B as described above, with a difference in positions where the ink receivers 104*g*-104*k*, 104*m*-104*r* are arranged.

Accordingly, the second recording medium support surface (Surface B) shown in FIG. 3B allows each recording sheet S to pass through each side of the ink receiver 104*i*, so that a borderless image can be printed onto each recording sheet S by ink-jetting. In this case, each recording sheet S can be of two different width sizes (paper widths: $P_1$, $P_2$ and $Q_1$, $Q_2$ (corresponding ink receivers provided on opposite side: 104*j*, 104*k*, 104*h*, 104*g*)). On the other hand, the third recording medium support surface (Surface C) shown in FIG. 4B allows each recording sheet S to pass through each side of the ink receiver 104*i*, so that a borderless image can be printed onto each recording sheet S by ink-jetting. In this case, the recording sheet S to be passed through one side of the ink receiver 104*q* is of one width size P (corresponding ink receivers provided on opposite side: 104*r*) and the recording sheet S to be passed through the other side of the ink receiver 104*q* can be of three different width sizes Q ($Q_1$, $Q_2$, $Q_3$, (corresponding ink receivers provided on opposite side: 104*p*, 104*n*, 104*m*)).

Next, the ink absorbing member surface (Surface D) shown in FIG. 5B will be described.

The ink absorbing member surface (Surface D) having an ink receiver 104*s* formed of an ink absorbing member, across the full width in the width direction as shown in FIG. 5A, is used for receiving the ink ejected during a so-called pre-ejection operation (flushing) which is performed prior to the start of the borderless image recording by ink-jetting, in which ink is ejected from an array of nozzles for removing any ink clogging in order to prevent the platen from being stained by ink.

Various known methods are available for controlling the rotatable portion 102*a* of the rotatable platen 102 having various functions as described above. For example, a photoelectric encoder is provided between the inner surface of the fixed part of the rotatable platen 102 and the side edge part of the rotatable portion 102*a*, through which rotation amount is calculated, or a servomotor is used to drive the rotatable platen 102.

The printer (inkjet printer) 10 according to this embodiment is basically configured as described heretofore.

Next, characteristic operations of the printer 10 will be described.

For instance, in order to perform borderless printing by ink-jetting onto recording sheets S (paper width sizes: $P_2$, $Q_2$) that are transported in a two row transport pattern as shown in FIGS. 3A and 3B, first after a certain period of blank, the control section 24 drives the driving means 112 to arrange the ink absorbing member surface (Surface D) of the rotatable platen 102 in a position (angle) facing the recording head 100*a*.

The control section 24, then allows the recording head 100*a* to perform pre-ejection operation (flushing) prior to the start of the image recording. In this case, all the ejected ink is absorbed by the ink absorbing member surface (Surface D) so that the platen surface is free from being stained by ink.

Upon completion of a predetermined pre-ejection operation, the control section 24 drives the driving means 112 to arrange the second recording medium support surface (Surface B) of the rotatable platen 102 in a position (angle) facing the recording head 100*a*, in replace of the ink absorbing member surface (Surface D) of the rotatable platen 102.

In this status, the control section 24 then starts transportation of the recording sheets S in a two-row transport pattern, and at almost the same time, starts borderless printing with the recording head 100*a*.

In this embodiment, since the ink receivers 104*k*, 104*i*, 104*g* are arranged in positions corresponding to the width sizes ($P_2$, $Q_2$) of the recording sheets S, borderless printing can favorably be performed onto the recording sheets.

In other words, after a leading edge of a rolled recording sheet S reaches the rotatable platen 102 (recording head 100*a*), the ink absorbing member surface (Surface D) of the rotatable platen 102 becomes unnecessary, and then the recording medium support surface (Surface B) of the rotatable platen 102 is arranged in a position facing the recording head 100*a* so that owing to ink absorbing action to be provided by the ink receivers 104*g*-104*k* that are arranged outside of the both edges of each recording sheet S, ink stain is prevented and borderless printing can be performed favorably.

Then, printing is performed continuously. When a trailing edge of the recording sheet S reaches a point close to the rotatable platen 102 (recording head 100*a*), the control section 24 uses an end of printing as a timing to drive the driving means 112 to rotate the rotatable platen 102 to arrange, in replace of the recording medium support surface (Surface B), the ink absorbing member surface (Surface D) of the rotatable platen 102 in a position (angle) facing the recording head 100*a*. This eliminates possibility of staining the platen with ink, even if, due to some reason, ink is ejected from the recording head 100*a* toward the platen where the trailing edge of the recording sheet S has already passed through.

Next, in order to perform borderless printing by ink-jetting onto recording sheets S that are transported in a transport pattern different from that used in the above described case, the control section 24 allows the recording head 100*a* to perform, prior to the start of the image recording, pre-ejection operation (flushing) with the ink absorbing member surface (Surface D) of the rotatable platen 102 being arranged in a position (angle) facing the recording head 100*a*. It should be noted that such pre-ejection operation (flushing) can be omitted depending on the time elapsed from the last printing.

Upon completion of a predetermined pre-ejection operation, the control section 24 drives the driving means 112 to arrange the first recording medium support surface (Surface A) of the rotatable platen 102 corresponding to a new transport pattern (in the description, a case shown in FIGS. 2A and 2B in which borderless recording is performed using center alignment by ink-jetting on recording sheets S having three different width sizes (P, Q, and R) is exemplified) in a position (angle) facing the recording head 100*a*.

The control section 24 in this status then starts the transportation of a recording sheet S having a predetermined width size (for example, Q out of the above P, Q, and R), and almost at the same time, starts borderless printing with the recording head 100*a*.

Subsequent operations are the same as the case described above.

As described heretofore, in the above embodiment, borderless printing can be performed onto recording sheets S, in which each recording sheet S is transported in a different transport mode, by selecting, under the control of the control section 24, a recording medium support surface suitable for each transport pattern, and rotating the rotatable platen 102 so that the selected recording medium support surface is stopped in a position facing the recording head 100*a*. In addition, under the control of the control section 24, the rotatable platen 102 is rotated to allow the ink absorbing member surface (D) to stop at a position facing the recording head 100*a*, according to various driving conditions of the recording head 100*a*, for example, if this operation first after the apparatus is powered on or not, if this operation first after any maintenance or not, how many hours have elapsed after the last operation, and the like. Accordingly, pre-ejection operation can easily be performed, and a recording medium support surface of the rotatable platen 102 suitable for a desired transporting pattern as described above can be selected, and therefore image recording for preparing a borderless print can easily be performed.

According to the embodiment, an image recording apparatus with a platen capable of switching ink receiver arrangements is achieved, that may suitably be used for borderless printing by ink-jetting, and that enables one single apparatus to perform image recording onto a plurality of different width size recording media, or allows multiple rows of recording medium to be transported in parallel for performing image recording (drawing) or post treatment subsequent to the image recording.

It should be noted that, if the image recording is performed based on PWA technology, there are following effects in addition to the above.

That is, when changing the recording medium support surface of the rotatable platen 102, the carriage on which the recording head is mounted can be retracted, in a transport direction of the recording sheet S, from the rotatable portion 102*a* of the rotatable platen 102. This allows the recording medium support surface to be changed without interfering with the recording head, which in turn leads to a possibility of reduction in distance between the recording head and the recording medium.

The image recording apparatus of the present invention has been described heretofore in detail. However, the prevent invention is not limited to the embodiments described above and it is of course possible to make various modifications and changes without departing from the gist of the present invention.

What is claimed is:

1. An image recording apparatus comprising:

a recording head which ejects ink for image recording on one or more recording media;

a rotatable platen which faces said recording head, extends in a direction perpendicular to a recording medium transport direction, and comprises recording medium support surfaces supporting said one or more recording media during the image recording, respectively;

driving means for rotating said rotatable platen; and control means for controlling said driving means so as to rotate said rotatable platen in such a way that a predetermined recording medium support surface selected from said recording medium support surfaces of said rotatable platen is stopped at a position facing said recording head in accordance with a transport pattern of said one or more recording media during the image recording, wherein said recording medium support surfaces support said one or more recording media transported in accordance with different transport patterns, respectively and have ink receivers that receive the ink which is ejected from said recording head during the image recording and has reached outside both side edges of each of said supported one or more recording media in said recording medium transport direction and are disposed in positions corresponding to vicinities of both side edges of each of said supported one or more recording media.

2. The image recording apparatus according to claim 1, wherein each of said recording medium support surfaces has suction holes for sucking and supporting said one or more recording media.

3. The image recording apparatus according to claim 1, wherein said rotatable platen further comprises an ink absorbing member surface having an ink absorbing member for receiving ink ejected as a pre-ejecting operation of said recording head prior to start of the image recording, and said control means further controls said driving means so as to rotate said rotatable platen in such a way that said ink absorbing member surface is stopped at a position facing said recording head prior to the start of the image recording in accordance with a recording head driving condition of said recording head.

4. The image recording apparatus according to claim 1, wherein said predetermined recording medium support surface corresponds to a predetermined recording medium transport pattern selected from said different recording medium transport patterns and supports said one or more recording media transported in accordance with said predetermined recording medium transport pattern, and said ink receivers are disposed in respective positions corresponding to vicinities of both side edges of each of said one or more recording media transported in accordance with said predetermined recording medium transport pattern.

5. The image recording apparatus according to claim 1, wherein each of said predetermined recording medium support surfaces corresponds to different recording medium transport patterns and supports said one or more recording media transported in accordance with each of said different recording medium transport patterns, and said ink receivers of each of said predetermined recording medium support surfaces are disposed in respective positions corresponding to vicinities of both side edges of each of said one or more recording media transported respectively in accordance with said different recording medium transport patterns to which each of said predetermined recording medium support surfaces corresponds.

6. The image recording apparatus according to claim 1, wherein each of said predetermined recording medium support surfaces has said ink receivers disposed in respective positions corresponding to vicinities of both side edges of each of said one or more recording media transported in accordance with said different recording medium transport patterns.

7. The image recording apparatus according to claim 6, wherein said ink receivers disposed on each of said predetermined recording medium support surfaces correspond to two or more different recording medium transport patterns.

8. An image recording apparatus comprising:

a recording head which ejects ink for image recording on one or more recording media;

a rotatable platen which faces said recording head, extends in a direction perpendicular to a recording medium transport direction, and has recording medium support surfaces, each of said recording medium support surfaces corresponding to each of different recording medium transport patterns and supporting said one or more recording media transported in accordance with each of different recording medium transport patterns during the image recording;

driving means for rotating said rotatable platen; and control means for controlling said driving means so as to rotate said rotatable platen in such a way that a predetermined recording medium support surface corresponding to a predetermined recording medium transport pattern selected from said different recording medium transport patterns is stopped at a position facing said recording head, wherein said predetermined recording medium support surface has ink receivers that receive the ink which is ejected from said recording head during the image recording and has reached outside both side edges of each of said one or more recording media in said recording medium transport direction transported in accordance with said selected predetermined recording medium transport pattern and are disposed in positions corresponding to vicinities of both side edges of each of said transported one or more recording media.

9. The image recording apparatus according to claim 8, wherein each of said recording medium support surfaces has suction holes for sucking and supporting said one or more recording media.

10. The image recording apparatus according to claim 8, wherein said rotatable platen further comprises an ink absorbing member surface having an ink absorbing member for receiving ink ejected as a pre-ejecting operation of said recording head prior to start of the image recording, and said control means controls said driving means so as to rotate said rotatable platen in such a way that said ink absorbing member surface is stopped at a position facing said recording head prior to the start of the image recording in accordance with a recording head driving condition of said recording head.

* * * * *